US005664374A

United States Patent [19]

Lee

[11] Patent Number: 5,664,374

[45] Date of Patent: Sep. 9, 1997

[54] SNOW GUARD WITH REINFORCED SNOW-STOP AND GUSSETED BRACE

[76] Inventor: Vicki Parker Lee, 9718 Lakeshore Blvd., Bratenahl, Ohio 44108

[21] Appl. No.: 638,015

[22] Filed: Apr. 25, 1996

[51] Int. Cl.[6] ..... E04D 13/00

[52] U.S. Cl. ..... 52/24; 52/26

[58] Field of Search ..... 52/24–26

[56] References Cited

U.S. PATENT DOCUMENTS

| | | | |
|---|---|---|---|
| D. 30,788 | 5/1899 | Clark . | |
| D. 109,967 | 5/1938 | Cody | D8/499 |
| D. 364,556 | 11/1995 | Bowie . | |
| 625,144 | 5/1899 | Clark . | |
| 1,530,233 | 3/1925 | Campbell . | |
| 1,647,345 | 11/1927 | Douglas . | |
| 1,732,936 | 10/1929 | Hudson | 52/24 |
| 1,863,561 | 6/1932 | Brinker et al. . | |
| 3,296,750 | 1/1967 | Zaleski | 52/24 |
| 5,343,659 | 9/1994 | Zaleski | 52/24 |
| 5,371,979 | 12/1994 | Kwiatkowski | 52/24 |

*Primary Examiner*—Carl D. Friedman
*Assistant Examiner*—Beth Aubrey
*Attorney, Agent, or Firm*—Alfred D. Lobo

[57] ABSTRACT

An economical three-component snow guard comprising (1) a laminar strap, (2) a snow-stop and (3) a gusseted brace is reinforced and its rigidity and compressive strength greatly improved. At the same time, the resistance to damage due to re-freezing of melted snow, and internal weathering of the brace, is essentially eliminated. The disdavantages of a structurally similar prior art snow guard are unexpectedly avoided by providing particularly improved structural features. The novel snow guard, formed as a unitary structure of foldable sheet metal less than 2 mm thick, can withstand not only the forces exerted by an accumulated snow pack, but also the compressive force of a person's weight exerted in either the down-roof or vertical directions.

17 Claims, 7 Drawing Sheets

SNOW GUARD WITH REINFORCED SNOW-STOP AND GUSSETED BRACE

BACKGROUND OF THE INVENTION

Much effort has been devoted to making an effective snow guard which is user-friendly as well as economical. A record of the results of the effort go back for over a century, and the effectiveness of a wide array of snow guards in harsh winter conditions in particular parts of the world subject to ice storms and heavy snow falls, is annually put to the test. The basic components of a snow guard are (i) a laminar base or "strap", (ii) a snow-restraining component referred to as a "snow-stop" herein, this component providing the surface area which resists forces exerted by an accumulated snow-pack, and (iii) a "leg" or "web" which supports and reinforces the snow-stop. Considering the simplicity of design of a snow guard it would appear that there is no reason why a snow guard should fail, or result in fracturing a slate or tile on which the snow guard rests. Clearly, casting the critical components, namely (ii) and (iii) of the snow guard will provide a rugged snow guard, but at higher cost than forming at least one of those components of sheet metal. Representative of such snow guards with a cast metal snow-stop having a V-shaped brace for greater reinforcement of the restraining member, is one disclosed in U.S. Pat. No. 1,863,561 to Brinker et al. (1929), and such cast snow-stops are presently popular in the up-scale market despite the known economies of sheet metal snow-stops because the received wisdom is that sheet metal snow-stops are less durable.

The economics of using sheet metal benefitted a conical snow-stop of sheet metal disclosed in U.S. Pat. No. 1,732,936 to Hudson (1929). The conical snow-stop relies on the area presented by the internal surface of the cone to provide resistance, but the sheet metal cone is readily deformed in compression vertically, and collapses under the weight of a person who inadvertently steps on the cone while inspecting the roof or carrying out maintenance on it. Reference to the vertical direction herein is relative to the horizontal plane in which the longitudinal base of the snow guard is presumed to lie when not in use, and not relative to the surface of the roof on which the snow guard is deployed. To provide resistance to deformation by a large vertical compressive force, U.S. Design Pat. No. 364,556 to Bowie (1995) discloses a vertical snow-stop braced with a downwardly tapered axial web. However, the triangular side portions of the snow-stop are not adequately braced by the web, and one or both of these side portions will be deformed under occasional abnormally heavy pressure of a snow-pack.

U.S. Pat. Nos. 625,144 and Des. 30,788 to E. W. Clark (1899) provided the basic design concept which has been modified over the ensuing century. This design provided a laminar base supporting an elevated projection (also referred to as a foot, shelf, cornice or hood) which is reinforced by a web (or "leg"). Key modifications were disclosed during the period from 1925 to 1967 in U.S. Pat. No. 1,530,233 to Campbell, U.S. Pat. No. 1,647,345 to Douglas, and U.S. Pat. No. 3,296,750 to Zaleski. Most recently a sheet metal support with a east bronze foot have been used in U.S. Pat. No. 5,343,659 to Zaleski and U.S. Pat. No. 5,371,979 to Kwiatkowski et al.

To overcome the susceptibility to deformation of the snow-stop under pressure, the '979 patent discloses the restraining member (referred to herein as the snow-stop) being preferably formed by casting a metal such as bronze, aluminum or iron, especially bronze or lead-coated bronze.

When combined with a cast web, the snow-stop is effective but less economical than sheet metal. In the '979 configuration, the circumference of the shank of the rivet attaching the support to the leg of the restraining member is "worked" by compressive forces against the restraining member, loosening the interference fit between the shank, the leg and the support. When the fit is loosened, the leg is prone to a pivoting action which engages the down-roof end of the leg against the base of the snow guard, resulting in a camming action. The camming action, in turn, tends to fracture a shingle, particularly if the up-roof end of the laminar base is hooked to the up-roof (front or upper) edge of a shingle. The term "shingle" is used herein to refer to a laminar roofing element which may be slate, tile formed from cement or fired clay, or, a weather resistant organic material such as asphalt, optionally reinforced with inorganic fibers or particulate matter. The foot provides a bending moment which tends to bow the laminar base between its up-roof end where it is attached to the roof, and the base's down-roof (rear or lower) end to which the foot and web are attached. When subjected to substantial forces due to snow loading, cyclically, the bowing not only causes metal fatigue but can also break the underlying shingle. Concern about damage due to bowing is evidenced in the '979 patent where it states, "Regarding the great strength of snow stops hereof, . . . with the base fixed to a test stand and force gauge in a manner to prevent bowing in test performance." (col 4, lines 34–39).

With particular regard to a slate roof, each slate is typically secured with two nails. Because of the angulation of the slate lying over another in a contiguous lower row, the lower surface of a nail's head is spaced apart from the roof deck by nearly twice the thickness of the slate. Therefore such nails driven through a slate, with their heads projecting in spaced-apart relation to the roof's deck are more inclined to bend and shear under high snow loading than nails which are flush-driven through the laminar base of a snow guard, into the deck (see FIG. 6). When a snow guard is hooked on to the up-roof edge of a slate, the slate breaks, serving its sacrificial function to avoid damaging the snow guard. This function was economical in the 19th century when slate or tile and the labor to replace them were relatively inexpensive, in comparison to the cost of copper or brass snow guards. To have to replace either a broken shingle or a damaged snow guard is no longer acceptable.

A snow guard made from a foldable sheet metal, which snow guard comprises a laminar strap, a snow-stop and a gusseted brace, has recently been marketed. The snow-stop comprises (a) an upstanding arcuate member in the form of a semi-circular disc with an unflanged periphery, referred to as a "barrier" which restrains the snow-pack, and (b) a barrier-base, integral with the barrier and bent at right angles thereto so as to provide a laminar base which is secured to the upper surface of the strap. In particular, the gusseted brace provides upstanding generally trapezoidal flange portions, referred to as "trapezoidal tabs", which are button-riveted to the down-roof surface of the barrier. This prior art gusseted brace avoids using a web or leg, and avoids using a rivet which, if worn and loosened in the web, would result in a camming action. The barrier is thus reinforced around the periphery of a pyramid-shaped cavity having a triangular base, formed by the gusseted brace.

However, the unflanged periphery of the barrier of this prior art snow guard fails to provide optimum rigidity of the periphery of the barrier as the trapezoidal tabs reinforce only an inner circumferential portion of the barrier's down-roof area. This inner portion is spaced apart from the periphery, leaving the peripheral portion un-reinforced. This peripheral portion of the down-roof surface of the barrier, which portion is not reinforced by the trapezoidal tabs, is therefore less resistant to down-roof force than the remaining inner portion which is reinforced with the trapezoidal flange portions. In the novel snow guard, the arcuate flange portions, each shaped as a segment, or portion of a segment of a circular disc, leave substantially no peripheral portion of the down-roof surface of the barrier unreinforced.

Further, since the prior art barrier has no peripheral flange, it does not protect the meeting plane of the barrier and the trapezoidal tabs, allowing the cavity under the brace to collect melting snow or acid rain which enters through a gap between the trapezoidal tabs and the down-roof surface of the barrier. When trapped liquid freezes in the cavity, expanding ice produces disruptive pressures on the seams of the brace. Moreover, trapped liquid accelerates what is referred to in the art as "internal weathering", and more correctly, corrosion. A more detailed comparison between the structural configuration of the prior art gusseted snow guard and the gusseted snow guard of this invention is provided herebelow in the Detailed Description.

SUMMARY OF THE INVENTION

The three components of the snow guard are (1) a laminar strap, (2) a snow-stop and (3) a brace. It has been discovered that the rigidity and compressive strength of a highly economical three-component snow guard, as well as the resistance to damage due to re-freezing of melted snow, can be unexpectedly enhanced; and, internal weathering of the brace, can be essentially eliminated by the use of a peripheral flange means on the snow-stop. The peripheral flange protects the meeting plane of the brace and the down-roof surface of the unflanged snow-stop. The meeting plane is defined by the down-roof surface of the snow-stop contacting the up-roof surface of the brace. In this novel snow guard, the meeting plane is protected from both melting snow, as well as acid rain which might otherwise be trapped between these surfaces, and also in the space confined by the brace and the laminar strap. It is recognized that the corrosive effect of acid rain may also be minimized by soldering the surfaces together with lead-tin solder but soldering a snow guard's components is uneconomical and impractical. A structurally similar prior art snow guard with a gusseted brace has a snow-stop with a semi-circular barrier without a circumferential peripheral flange. As a result, the snow-stop's periphery is not reinforced, and the meeting plane is unprotected against entry of melting snow and rain through a gap in the meeting plane. The disadvantages of the prior art snow guard are unexpectedly avoided by providing particularly modified structural features in a unitary combination of snow guard components, the result-effectiveness of which combination is unexpected.

It is therefore a general object of this invention to provide a new and improved unitary snow guard comprising a longitudinal laminar strap, a snow-stop having a peripheral flange means, the snow-stop fixedly secured to the strap's upper surface, and a shaped, gusseted brace fixedly secured both to the snow-stop and the strap. The strap is conventionally secured to a roof member, preferably by attaching the strap directly to the roof's deck with appropriate fastening means, or by hooking the strap's up-roof end over the up-roof edge of a shingle. Each of the three components of the snow-guard is preferably formed economically from foldable sheet metal, though the snow-stop may be cast if desired, from an appropriate weather-resistant metal, preferably brass. The strap's down-roof end terminates in a generally triangular shape having angulated edges symmetrically, oppositely disposed about the strap's longitudinal axis.

The snow-stop comprises (i) a generally planar upstanding barrier having an arcuate profile (viewed in elevation along its longitudinal axis), and the barrier has a peripheral flange means projecting down-roof, orthogonally from the periphery of the barrier for a distance sufficient to protect the bartlet's down-roof surface against impingement by rain falling vertically; and (ii) a barrier-base fastened in contact with the strap's upper surface. The peripheral flange means is preferably continuous and may be beveled downwardly or crimped to snugly embrace the periphery of the up-roof portion of the brace. The barrier-base projects laterally up-roof, at a right angle with the barrier so that the snow-stop with its barrier is directly attached to the upper surface of the strap with no space therebetween. Most preferably, the barrier has a generally semi-circular configuration which, for the amount of metal used, provides a maximum surface area offering maximum resistance in the longitudinal direction.

The unitary brace comprises a downwardly tapered main body having a gusset with angulated lateral flanges and optionally, vertical arcuate flange portions. A large opening in the brace is closed when it is abutted against the down-roof surface of the barrier. The large opening is defined by a cross-section in a vertical plane of abutment where the up-roof portion of the gusset abuts the barrier as it rests on the laminar strap. The plane of abutment is protected by the peripheral flange means on the barrier, a continuous flange being preferred to protect the entire arcuate line of contact between brace and barrier from impingement by rain. Along each side of the main body project a pair of lateral flanges. The structural element from which the lateral flanges project is referred to in the art as a gusset.

The gusset may be formed as plural, preferably 2 to 8, downwardly (in the down-roof direction) angulated triangular elements each having one common side, that is, one side in common with a contiguous triangular element. Such a gusset, referred to herein as having a "pyramidal shape", requires at least a pair of triangular elements disposed in mirror-image relationship, symmetrically about the longitudinal axis. The gusset is most preferably formed from two to six (2 to 6) triangular elements, each having a common side with a contiguous element. When the gusset has a pyramidal shape the arcuate line of contact between brace and barrier is a serrated line.

The gusset may also be formed as portion of a cone, in which embodiment the gusset is referred to as having a "conical shape". When the gusset has a conical shape the arcuate line of contact between brace and barrier is an arc, this being the periphery of the portion of the cone.

Because the brace is tapered and symmetrical about the longitudinal axis, the lateral flanges (in the horizontal plane) project angularly relative to the longitudinal axis of the main body. The lateral flanges project in a V-shape, angularly equal but oppositely directed, and are referred to herein as "angulated lateral flanges".

In a first embodiment, referred to as the "unfastened brace" embodiment, the large opening of the main body abuts the barrier without the brace being mechanically fastened to the barrier. In this unfastened brace embodiment, the gusset, whether pyramidal or conical, has only angulated lateral flanges. Whether the gusset is pyramidal or conical it is essential that the periphery of the large opening is directly under the peripheral flange means of the barrier and snugly abuts the down-roof surface of the barrier; and, that the periphery of the large opening so closely conforms to the periphery of the barrier's down-roof surface as to leave no gap between the arcuate periphery of the large opening and the barrier's down-roof surface. This limitation results in the rigidity and strength of the combined brace and snow-stop in compression being maximum for the chosen outer surface area of the gusset. If desired, the peripheral flange means may be beveled downwards to tightly confine the periphery of the up-roof end of the gusset.

In a second embodiment, referred to as the "fastened brace" embodiment, abutment of the large opening of the main body against the barrier is ensured by mechanically fastening the brace to the barrier, for example with rivets. In this fastened brace embodiment, the gusset whether pyramidal or conical, has not only the angulated lateral flanges, but vertically, oppositely disposed laminar arcuate flange portions on the periphery of the up-roof portion of the gusset. These arcuate flange portions which have peripheries conforming generally to the arcuate profile of the barrier, are fastened in contact with the barrier's down-roof surface. Each arcuate flange portion has a periphery extending over about one-half of an arc circumscribed around the arcuate flange portions, and the radius of the arc is preferably chosen to conform closely to that of the arcuate peripheral profile of the barrier.

More specifically, it has been discovered that the novel snow guard, formed as a unitary structure of foldable sheet metal less than 2 mm thick, and having a barrier with a peripheral flange means, can withstand not only the forces exerted by an accumulated snow pack, but also the compressive force of a person's weight exerted in either the down-roof or vertical directions; further, that when the brace is secured by its lateral flanges to the laminar strap so that the up-roof periphery of the large opening of the main body closely conforms to the arcuate profile of the barrier, its peripheral flange, optionally beveled, effectively restricts movement of the periphery of the opening without fastening the brace to the snow-stop; most preferably, vertically projecting arcuate flange portions of the brace are frictionally tightly secured against the down-roof surface of the barrier by crimping the peripheral flange means over arcuate flange portions. Still further, the snow-stop and unitary brace may be fastened together with mechanical fastening means, such as with button rivets.

In each embodiment, not only is the combination of the snow-stop and brace effectively unitized, but also the combination is reinforced by the peripheral flange means, and the meeting plane of the brace and the barrier is protected. In each embodiment, the up-roof periphery of the gusset is snugly abutted against the down-roof surface of the barrier and the periphery of the gusset closely matches the periphery of the barrier from which periphery the peripheral flange means projects. When the gusset is provided with laminar vertical tabs with an arcuate periphery, the arcuate periphery of the tabs closely matches that of the periphery of the barrier. When the gusset is not provided with laminar vertical tabs, the periphery of the gusset, whether partially polygonal or arcuate (typically semi-circular), closely matches that of the periphery of the barrier. The structural strength of the snow guard is surprisingly improved because it is formed as a unitary body in which the combination of the snow-stop and brace mimicks a solid cast or otherwise molded body fastened to the laminar strap, even if the snow guard is not formed as a unitary body by molding; and the angulated lateral flanges are tightly secured to the laminar strap by overturning and tightly rolling the angulated side edges of the down-roof portion of the strap over the lateral flanges, providing liquid-impermeable, sealed edges.

BRIEF DESCRIPTION OF THE DRAWING

The foregoing and additional objects and advantages of the invention will best be understood by reference to the following detailed description, accompanied with schematic illustrations of preferred embodiments of the invention, in which illustrations like reference numerals refer to like elements, and in which:

FIG. 10 is an end elevational view of the prior art gusseted snow-stop viewed in the up-roof direction along the longitudinal axis of the strap of the snow guard; all components of the snow guard are made of copper sheet or galvanized steel sheet.

FIG. 11 is a plan view of a prior art laminar blank of sheet metal which is formed into a gusseted brace, the gusset comprising twin triangular elements having a common side and trapezoidal flange portions button-riveted to the down-roof surface of the snow-stop.

DETAILED DESCRIPTION OF PREFERRED EMBODIMENTS

Figure 1:
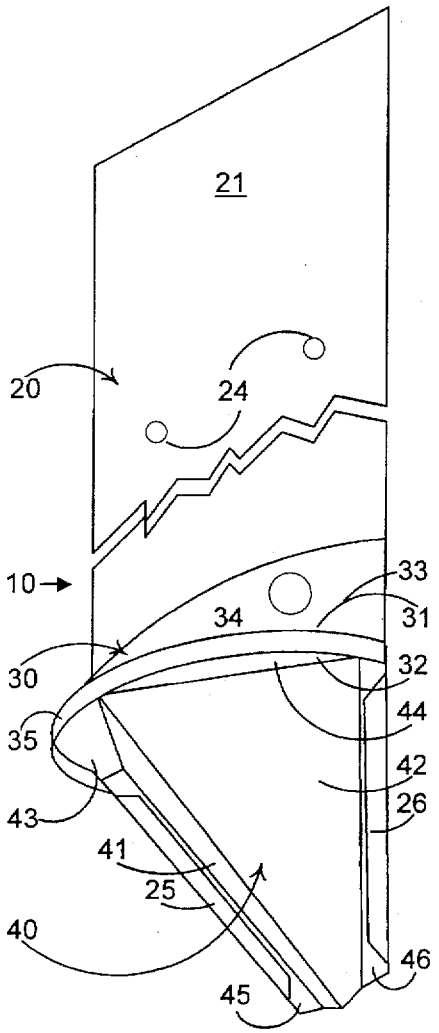
FIG. 1 is a perspective view of an embodiment of a snow guard having a brace with a gusset of pyramidal shape comprising twin triangular elements.

As illustrated in perspective view in FIG. 1, an individual snow-guard 10 comprises three structural elements which are fixedly interconnected to produce a unitary article. The three structural elements are (a) a longitudinal laminar strap referred to generally by reference numeral 20, (b) an upstanding snow-stop 30, and (c) a unitary brace 40, having a main body portion 40' referred to in the art as a gusset. The strap 20 of a single thickness of sheet metal, has an up-roof end 21, and a down-roof end 22 (see FIG. 2) which, when positioned on a shingle of a roof, lies inclined to the vertical plane, in the longitudinal direction, at a lower level than the up-roof end 21. Snow-stop 30 is fixedly secured to the down-roof end 22 of the strap 20 so that the snow-stop's up-roof surface 31 stops snow; the snow-stop's down-roof surface 32 is braced by the brace 40 which is downwardly inclined.

Illustrated in FIGS. 2, 3A–3D and 4A–4D are blanks for the laminar longitudinal strap 20, the snow-stop 30 and the unitary brace 40, respectively, preferably formed from first, second and third foldable sheet metal elements which may be of the same weather-resistant metal or different, and of the same thicknesses or different, provided different metals are chosen not to have a deleterious effect in contact with one and another, and provided the thickness is no greater than 2 mm so as to be readily deformable. Typically, the metal is stainless steel, copper, or galvanized steel, the latter two being most preferred. The preferred thickness of copper corresponds to sheet stock in the range from 16 oz/ft$^2$ (ounces/square foot) to 40 oz/ft$^2$, most preferably 16–20 oz/ft$^2$; and the preferred thickness of galvanized steel corresponds to sheet stock in the range from 26 gauge to 18 gauge, most preferably 26–24 gauge. Sheet stock having a thickness in the aforementioned ranges is foldable 180° upon itself to form a seam which has great strength. Alternatively, the snow guard may be molded from a synthetic resinous material, for example recycled poly(vinyl chloride) (PVC) or acrylonitrile-butadiene-styrene (ABS) resin. preferably reinforced with an inorganic fiber such as glass.

Figure 2:
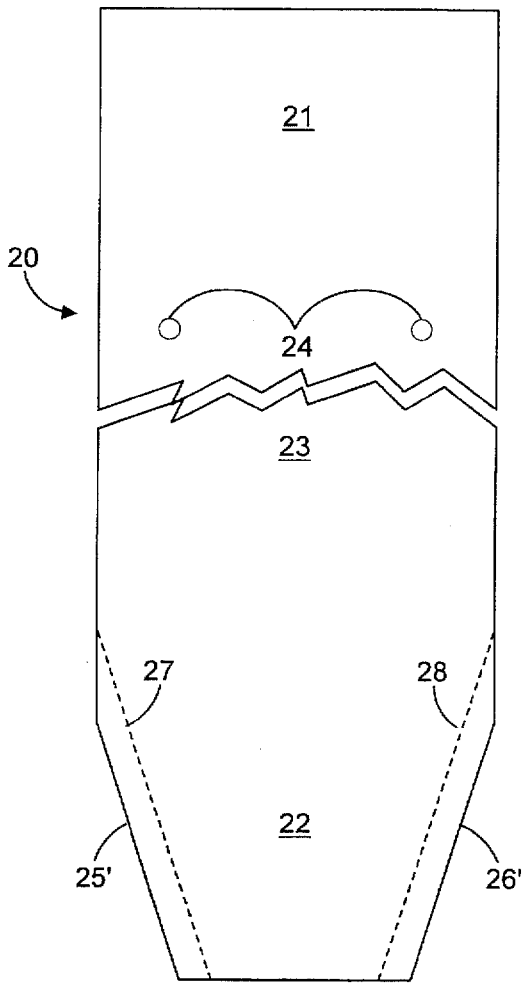
FIG. 2 is a plan view of a laminar blank of formable weather-resistant material which provides the strap used to fasten the snow guard to a roof member.

Referring to FIG. 2 there is illustrated a laminar strap 20 having an up-roof end 21 and a down-roof end 22 at either end of a flat body portion 23. The up-roof end is preferably adapted to be fixedly secured to the deck the roof and is provided with spaced apart through-apertures 24 for nailing or otherwise securing the strap to the deck. Alternatively, the up-roof end may be bent over so as to enable it to be hooked onto the upper edge of a shingle. The down-roof end 22 is generally triangular or trapezoidal in shape, the sides of the triangle or trapezium being equally angulated in the range from about 10° to 45° to the longitudinal central axis of the strap, but oppositely directed. Marginal strip portions 25, 26 respectively of the down-roof end 22 are shown in phantom view defined by dotted fold lines 27, 28 along which each strip portion is to be folded over, upwardly, through about 180°. Snow-stop 30 and brace 40 in abutting relationship are secured upon the down-roof end 22 by the folded-over marginal strip portions, conveniently determining that the width of the strap 20 be preferably the same as the width of the snow-stop 20.

Reverting to FIG. 1, the snow-stop 30 comprises an up-standing snow-restraining barrier 33 which is integral with, and arises vertically from, a basal flange, referred to as a barder-base 34, fixedly secured to the upper surface of the strap 20. Viewed down-roof along the longitudinal axis of the strap, the barrier 33 has a generally arcuate shape, preferably an arcuate segment having an area in the range from semi-circular to about 25% greater than semi-circular, and most preferably an approximately semi-circular configuration, the periphery of which is provided with flange means 35 which serves two functions: it provides rigidity to the circumferential portion of the barrier, and, it protects the down-roof surface 32 of the barrier against contact with water falling from above. Such water is trapped interstitially in the meeting-plane of the down-roof surface 32 of barrier 33 and the up-roof surface of the brace 40. The flange means 35 is most preferably a continuous peripheral flange, but may less preferably be provided by a series of circumferentially spaced apart tabs or "ears" projecting down-roof. Though such tabs facilitate locking the arcuate flanges 43, 44 to the barrier 33, it will be evident that enhancement of the rigidity of the barrier will be diminished by not providing a substantially continuous peripheral flange, as will be the lack of adequate protection against water being trapped in the meeting-plane. If such tabs are used it is therefore necessary to provide them over at least one-half of the periphery, and preferably over a major portion of the periphery.

As illustrated in FIG. 1, the barrier 33 is preferably flanged to form a peripheral flange 35 along the entire arcuate periphery, and the barrier is most preferably an approximately semi-circular disc, as shown. The flange 35 projects down-roof for a distance sufficient to extend over the down-roof face of the barrier to protect the meeting-plane of the barrier's down-roof surface 32 and the up-roof surfaces of the arcuate flanges of the brace. Preferably, the flange extends down-roof for from about 2 mm (3/32") to 10 mm (3/8") past the down-roof surface 32 of the barrier 33. In a preferred embodiment, the flange is beveled downward to provide an interference fit with vertically projecting arcuate segments, referred to as laminar arcuate flanges 43, 44 (see FIG. 8) of the brace's main body 40'. Alternatively, the peripheral flange is crimped over the laminar arcuate flanges 43, 44 to secure their up-roof faces tightly against the down-roof face of the barrier 33.

The snow-stop 30 may be formed by casting bronze or cast iron so as to provide the desired flange, optionally beveled, but it will be evident that the flange on a cast snow-stop will not be crimped over the arcuate flanges of the brace. Further, the barrier illustrated as a semi-circular disc may in addition include a fanciful decorative figure popular in the art, such as an eagle with its wings spread wide, or any other complementary geometric figure.

Figure 3B:
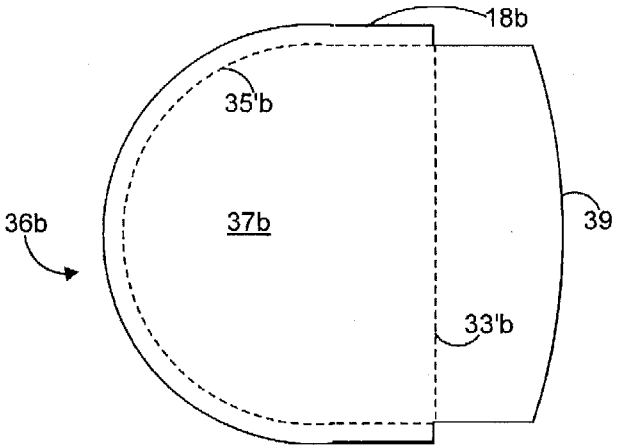
FIGS. 3A, 3B, 3C and 3D are plan views of laminar blanks of foldable sheet metal from any of which the snow-stop is formed.
Figure 3D:
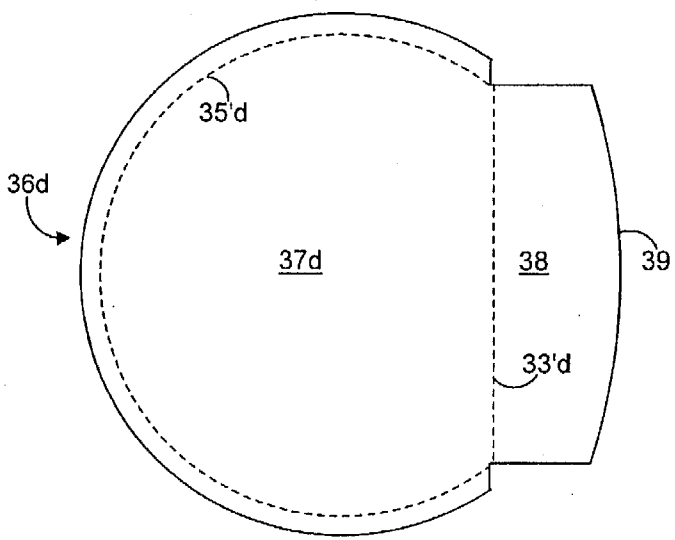
Figure 3A:
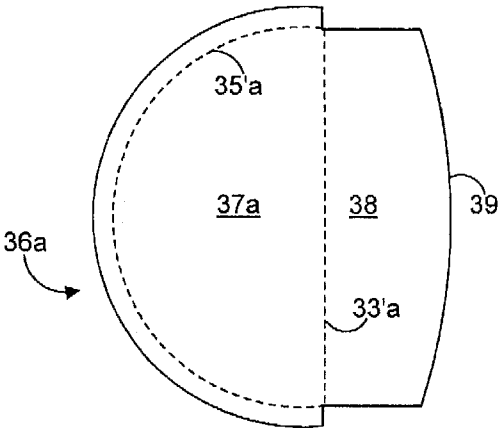

Referring to FIG. 3A, there is shown a shaped laminar blank **36*a* having a generally semi-circular disc portion 37*a* of a predetermined radius in the range from about 1" (2.54 cm) to about 3" (7.6 cm), most preferably in the range from about 1.25" (3.2 cm) to 2" (5 cm); and, a generally rectangular portion 38 shown in this view as having an arcuate edge 39 of large radius to deflect down-moving snow towards the sides of the barrier 33, after it is formed. Edge 39 is effective to deflect snow when the snow-stop is installed with its barrier sufficiently spaced-apart from an adjacent down-roof edge of a shingle as to expose the edge 39 and snow accumulates against the edge. Dotted line 33'*a* and arc 35'*a* indicate where the blank is bent at right angles to provide the barrier-base 38 and peripheral flange 35**, respectively.

Referring to FIG. 3B, there is shown a laminar blank **36*b* for a snow-stop having the same rectangular base 38 with an arcuate edge 39, but the snow-restraining surface of the semi-circular disc 37***b* is enlarged with a lower rectangular portion 18*b*. Thus, when the blank is bent at right angles along the dotted line 33'*b*, to form a barrier, it presents a lower rectangular portion and an upper semi-circular portion the combined height of which may be up to 3" (7.6 cm). As before, a peripheral flange is formed on the disc 37*b* by bending the peripheral margin downwards along the arc and sides 35'*b* of the disc and rectangle respectively.

Figure 3C:
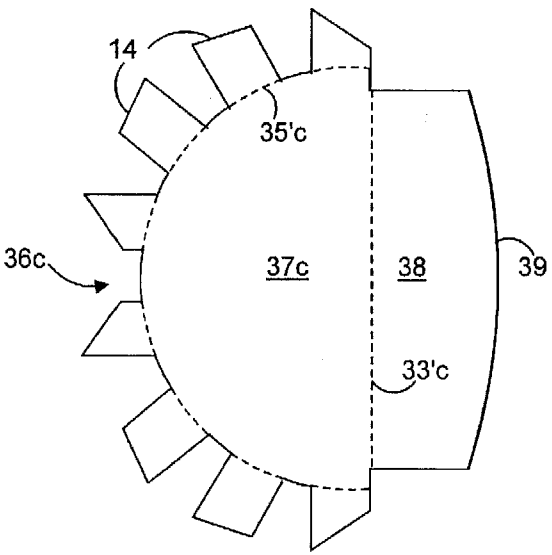

Referring to FIG. 3C, there is shown a laminar blank 36*c* for a snow-stop having the same rectangular base 38 with an arcuate edge 39, but the semi-circular disc 37*c* is provided with projecting tabs 14 which are to be bent downwards behind the up-roof surface of the barrier, after it is formed. The sum of the widths of the tabs along the periphery is at least one-half, and preferably at least 75% of the semi-circular periphery of the disc 37*c*. Additional tabs 14 are provided on the barrier-base which locks the tabs in slots in the strap to fasten the snow-stop.

Referring to FIG. 3D, there is shown a shaped laminar blank 36*d* having an enlarged arcuate segment 37*d*, the area of the segment being defined by the secant (dotted line 33'*d*) intersecting the periphery of the disc. As will be evident, the segment 37*d* affords a larger restraining surface than a semi-circle of the same radius without an increase in width of the laminar strap 20. As before, the blank 36*d* is provided with rectangular portion 38 having arcuate edge 39. Dotted line 33'*d* and arc 35'*d* indicate where the blank is bent at right angles to provide the barrier-base 38 and peripheral flange 35, respectively.

Reverting to FIG. 1, the brace 40 comprises a tapered structural gusset which braces the snow-stop against the force exerted by packed snow. The shape of the brace may be that of a partial cone, typically about one-half of a cone so that the surface is a semi-conical surface, or, that of a pyramidal element, provided the brace includes upstanding substantially vertical laminar arcuate flanges 43, 44 and laminar lateral flanges 45, 46 projecting at equal angles in opposed directions, symmetrically about the vertical plane containing the longitudinal axis. Preferably the main body 40' comprises a gusset with twin triangular elements 41 and 42 having contiguous apexes intersecting near a vertical plane containing the longitudinal central axis of the strap 20, the point of intersection being contiguous with the down-roof surface 32 of barrier 33. Each triangular element 41, 42 has an arcuate upper flange 43, 44 respectively. Each arcuate upper flange has an arcuate periphery extending over substantially one-half of the circumference of a semi-circle circumscribed around oppositely disposed arcuate flanges. The radius of the periphery of each arcuate flange is preferably chosen to closely match the periphery 35'*a* (FIG. 3A) of the peripheral flange 35, lying closely adjacent thereto, so as to have the flange protect the planar interstitial space between the metal meeting surfaces of the barrier 33 and the vertical flanges 43, 44 against entrapping damaging acid rain. By "meeting surfaces" I refer to the down-roof surface 32 of the barrier 33 and the up-roof surface of each arcuate flange 43, 44. A suitable radius which closely matches the periphery of the barrier 33 is in the range ±20% (plus or minus twenty percent) of the radius of the barrier 33. Most preferably the radius of the semi-circle confining the arcuate flanges is chosen to approximate the radius ±10% of the barrier 33 so that the arcuate flanges 43 and 44 are substantially coextensive with the periphery of the barrier and snugly fitted under the peripheral flange 35. At least one, and preferably both, of the arcuate flanges 43 and 44 is preferably fixed in overlying contact with the down-roof surface 32 of the barrier 33. The arcuate flanges 43, 44 provide incremental thickness of metal near the periphery of the barrier 33 reinforcing the strength along the periphery. The triangular elements 41, 42 are also provided with lateral flanges 45, 46 respectively, projecting angularly in opposed directions. These flanges 45, 46 are tightly secured in contact with the down-roof end 22 by the angulated marginal strip portions 25, 26 which are folded over the flanges 45, 46. The radius of a gusset without vertical flanges is chosen in an analogous manner.

Figure 4A:
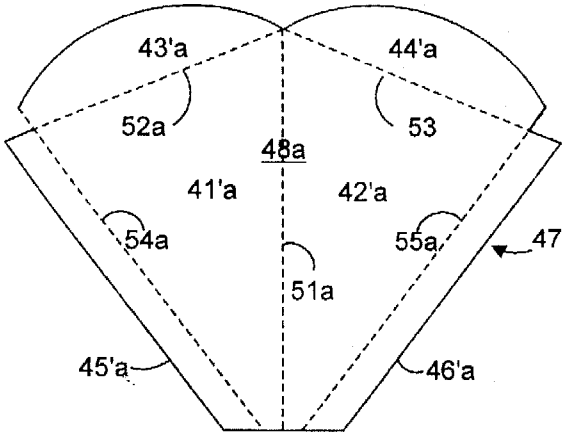
FIGS. 4A, 4B, 4C are plan views of laminar blanks of formable weather-resistant material which are formed into braces, each having a pyramidal gusset of twin, four and six triangular elements, respectively.

Referring to FIG. 4A, there is shown a laminar blank 47*a* having a generally trapezoidal main portion 48*a* and projecting tabs 43'*a* and 44'*a*. Dotted line 51*a* indicates the line along which opposed halves 41'*a* and 42'*a* of the main portion 48*a* are bent downwardly to form the main body 40' (of brace 40) and triangular elements 41 and 42, one the mirror-image of the other. Dotted lines 52*a* and 53*a* indicate the lines along which opposed projecting tabs 43'*a* and 44'*a* of equal area, are bent upwardly to form laminar arcuate upward flange portions 43 and 44 respectively of the brace 40. Dotted lines 54*a* and 55*a* indicate the lines along which equally angulated but opposed marginal portions 45'*a* and 46'*a* are bent to project laterally. When marginal portions 45'*a* and 46'*a* are locked under the tightly folded angulated marginal strip portions 25, 26 respectively of the down-roof end 22, liquid impermeable seals are formed, and at the same time, the brace 40 is secured under flange means 35 and against the down-roof surface 32 of barrier 33, preferably additionally, with button rivets 49 (see FIG. 8). The angles formed by the intersection of the edges of marginal portions 45' and 46' with the longitudinal axis 51 are each in the range from 25° to 45° with respect to the longitudinal axis.

Figure 4B:
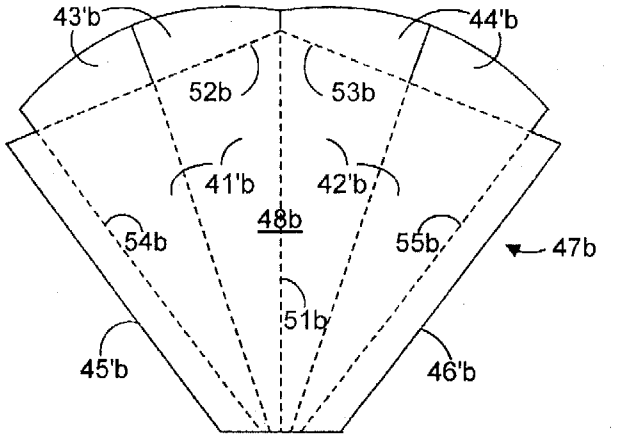

Referring to FIG. 4B, there is shown a laminar blank 47*b* having a generally trapezoidal main portion 48*b* and projecting tabs 43'*b* and 44'*b*. Dotted line 51*b* indicates the line along which opposed halves 41'*b* and 42'*b* of the main portion 48*b* are bent downwardly to form the main body 40' (of brace 40) and triangular elements 41 and 42, one the mirror-image of the other. Dotted lines 52*b* and 53*b* indicate the lines along which opposed projecting tabs 43'*b* and 44'*b* are bent upwardly to form laminar arcuate upward flange portions 43 and 44 respectively of the brace 40. The radial lines dividing the segments 43'*b* and 44'*b* represent slits between the portions of the segments, which slits are extensions of the radial lines along which the plural triangular elements of the gusset (two are formed on each side of the longitudinal axis). Dotted lines 54*b* and 55*b* indicate the lines along which equally angulated but opposed marginal portions 45'*b* and 46'*b* are bent to project laterally. As before, when marginal portions 45'*b* and 46'*b* are locked under the tightly folded angulated marginal strip portions 25, 26 respectively of the down-roof end 22, liquid impermeable seals are formed, and at the same time, the brace 40 is secured under flange means 35 and against the down-roof surface 32 of barrier 33, preferably additionally, with button rivets 49.

Figure 4C:
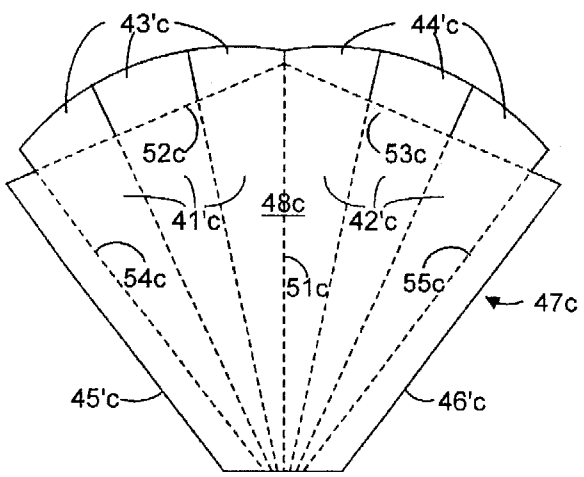

Referring to FIG. 4C, there is shown a laminar blank 47*c* analogous to that shown in FIG. 4B, blank 47*c* having a generally trapezoidal main portion 48*b* and projecting tabs 43'*b* and 44'*b*, except that blank 47*c* is to be formed into a main body having a gusset with six triangular elements.

Figure 4D:
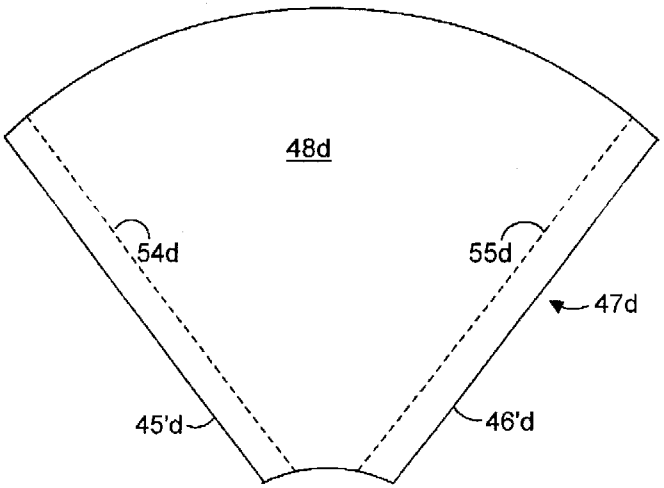
FIG. 4D is a plan view of a laminar blank of formable weather-resistant material which is formed into a brace having a gusset with a conical shape.

Referring to FIG. 4D, there is shown a laminar blank 47*d* having a generally pie-shaped main portion 48*b* which is to be formed into a gusset having a conical shape. No projecting tabs are shown projecting from the main portion 48*b*, though such tabs may be provided if desired. As before, dotted lines 54*d* and 55*d* indicate the lines along which equally angulated but opposed marginal portions 45'd and 46'd are bent to project laterally and be secured tightly under angulated marginal strip portions 25, 26 respectively of the down-roof end 22, to form liquid impermeable seals, at the same time securing the brace 40 under flange means 35 and against the down-roof surface 32 of barrier 33.

Figure 5:
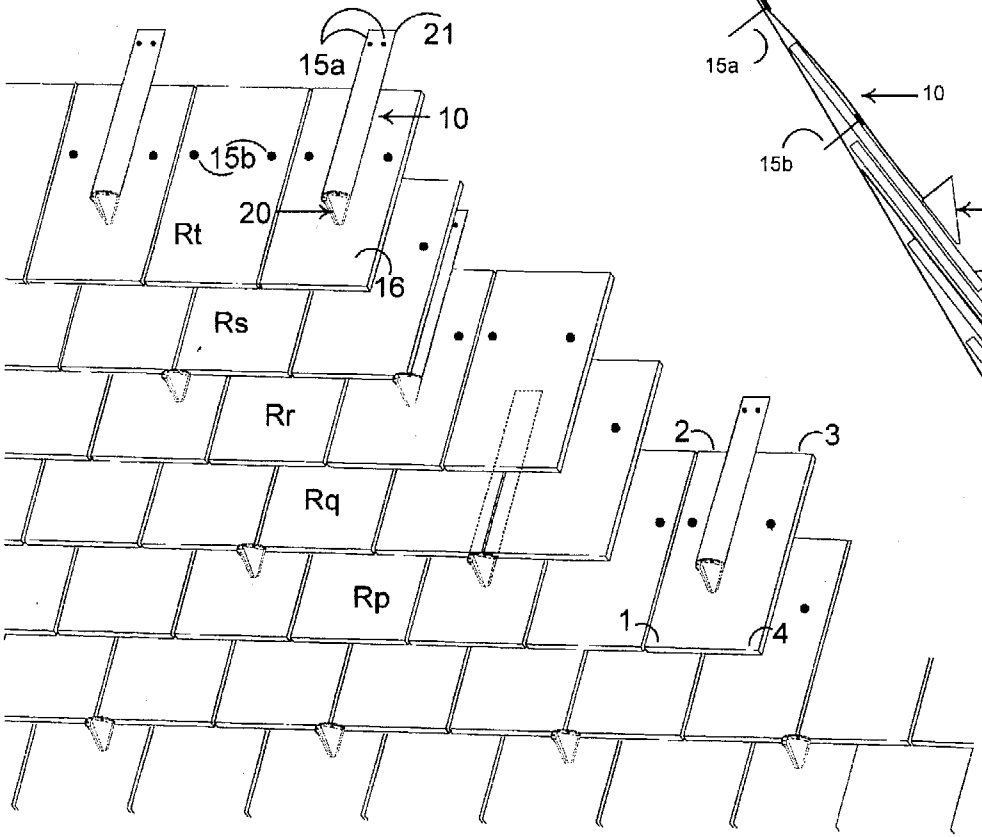
FIG. 5 is a perspective view of a portion of a roof overlaid with shingles of laminar slates or tiles in "double layer" configuration, showing how a snow guard is positioned with the down-roof edge of a slate or tile adjacent the barrier member of the snow-stop.

As illustrated in FIG. 5, snow guards 10 are disposed on a conventional pitched roof overlaid by rectangular laminar tiles or slate 16 in spaced-apart relationship, preferably regularly, and enough snow guards are used so that, cooperatively, they prevent packed snow accumulated on the roof from suddenly sliding off the roof and causing injury to gutters, or to shrubs and plants beneath the roof's edge, or to any person who happened to be positioned so unfortunately.

A snow guard 10 is installed so that its laminar strap 20 may be inserted and secured between shingles of overlapping adjacent courses $R_p$ and $R_q$. In a typical slate roof wherein successive courses $R_p$, $R_q$ and $R_r$ are "double-layered" slates 16, each about 18" (45.7 cm) long and 9" (22.8 cm) wide, slates in course $R_p$ have their lower portions exposed over about 7.5" (19 cm), a slate from the next adjacent course $R_q$ covers the slates in course $R_p$ over a distance of about 7.5" (19 cm) and slates from course $R_r$ overlap the up-roof ends of slates in course $R_p$ over a distance of about 3" (7.6 cm). The laminar strap 20 is positioned over the upper surface of a slate the corners of which are identified by numerals 1, 2, 3, 4 so that up-roof end 21 extends beyond the up-roof edge of a slate exposed in course $R_p$, and under the lower portion of a slate in row $R_r$. The up-roof end 21 is nailed with nails 15*a* (see FIG. 6) through apertures 24, stapled, screwed or otherwise fixedly secured directly to the roof's deck which is typically wood planks, or a composite veneer laminate, or weather-proof plywood. When thus secured along the longitudinal axis of a slate midway between its side edges, strap 20 rests substantially flat on the upper surface of the shingle in course $R_p$, about 7.5" of which (longitudinally) is exposed, the snow-stop 30 being disposed adjacent the down-roof edges of contiguous slates in course $R_q$. The strap 20, as shown, lies beneath the contiguous edges of the slates in course $R_q$, but may equally be positioned between the contiguous edges of two slates in row $R_q$. Additional snow guards 10 are similarly positioned on slates in alternate courses $R_p$, $R_r$, etc.

Figure 6:
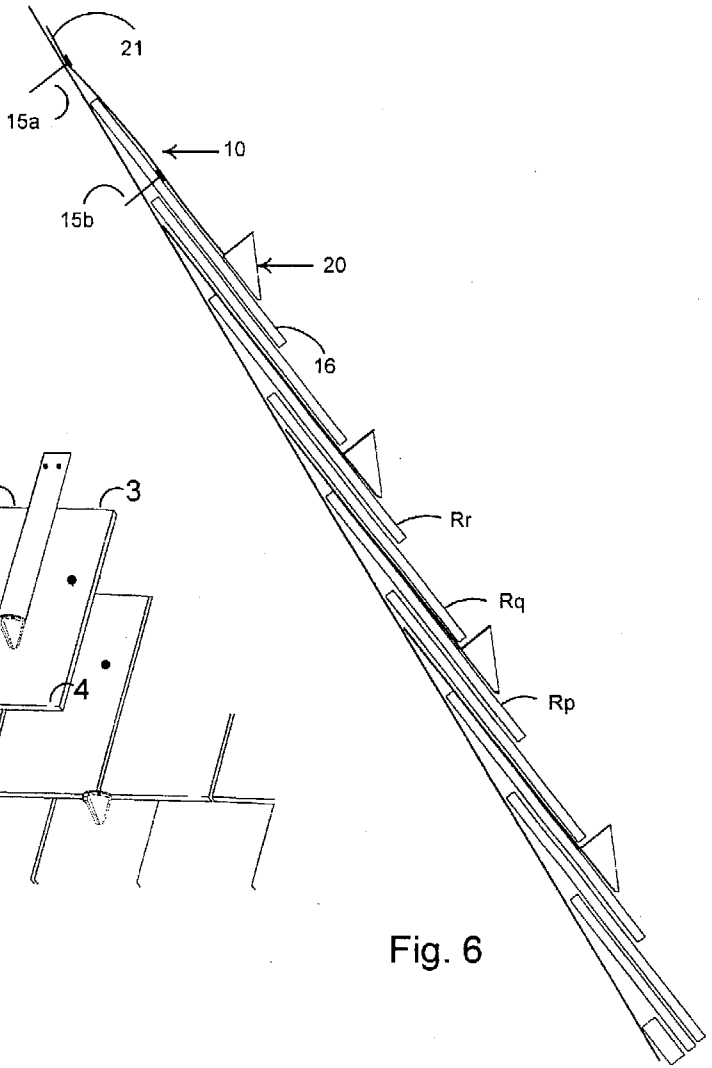
FIG. 6 is a cross-sectional elevational view of portion of the roof shown in FIG. 5, showing how the snow-stop on the down-roof end of the laminar strap rests on a slate or tile, and the up-roof end of the strap is directly nailed to the deck of the roof.

In FIG. 6 there is illustrated a cross-sectional view in side elevation, of the conventional slate roof having a series of snow guards spaced apart both laterally and vertically at regular intervals upon the slates in consecutive rows $R_p$, $R_q$, and $R_r$ on a newly installed slate roof. As seen, the up-roof ends 21 are directly fastened to the roof's deck with nails 15*a* the heads of which are flush-driven against the upper surface of the strap 20 secured to the roof-deck. The brace 40 prevents the barrier 33 from pivoting backwards thus essentially eliminating the bowing of the strap 20, and negating the breakage of slate when the snow guard is subjected to high forces exerted by an accumulated snow-pack. When nail 15*b* is driven through an aperture in a slate 16, and a snow guard hung (not shown) from that slate, a load against the snow-stop will bow the strap and nail 15*b* provides a fulcrum, causing the slate to break. The effect of the force is magnified because the shank of the nail projects above the surface of the deck for a distance which is approximately twice the thickness of the slate 16. The bending moment due to forces exerted at the head of the nail by the weight of an accumulated snow-pack commencing to slide is therefore much greater than the bending moment exerted on nail 15*a*.

Figure 7:
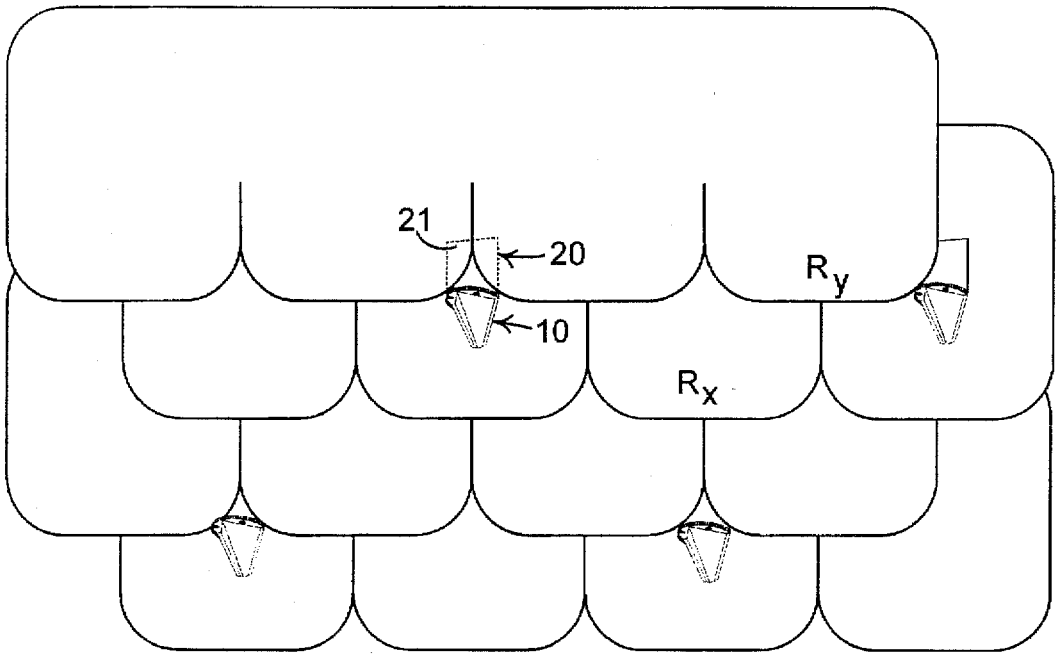
FIG. 7 is a perspective view of a portion of a roof covered with conventional asphalt shingles, showing how a snow guard is positioned with the down-roof edge of an asphalt shingle adjacent the barrier member of the snow-stop.

Illustrated in FIG. 7 is a roof protected with shingles made from a reinforced organic substrate such as glass fiber reinforced (GFR) asphalt, or GFR synthetic resinous material such as recycled poly(vinyl chloride) (PVC) or acrylonitrile-butadiene-styrene (ABS) resin. A snow guard 10 is positioned on a lower course of asphalt shingles $R_x$ with the up-roof end 21 nailed directly to the roof's deck. The length of strap 20' is much shorter than that of strap 20 because snow-stop 30 is positioned adjacent the next adjacent upper course of shingles $R_y$ which typically overlaps the up-roof portion of shingles in course $R_x$ only about 2" (5.1 cm).

Figure 8:
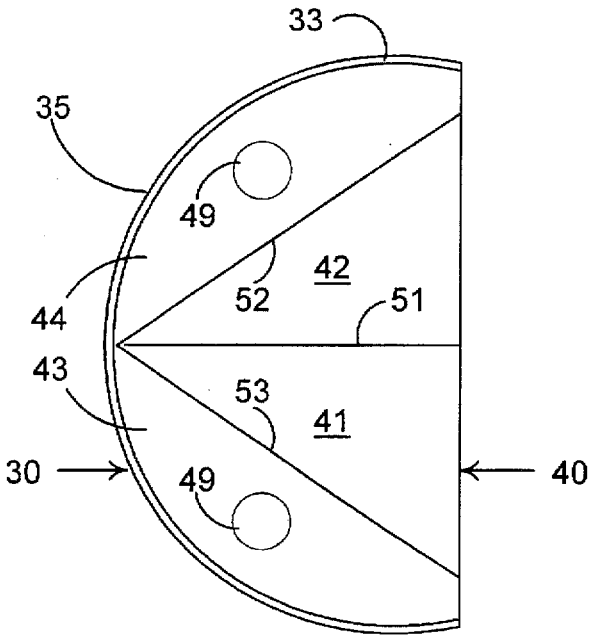
FIG. 8 is an end elevational view of a snow-stop viewed in the up-roof direction along the longitudinal axis of the strap of the snow guard showing a gusseted brace, the gusset comprising twin triangular elements having a common side and arcuate flange portions button-riveted to the down-roof surface of the snow-stop so that the meeting-plane of the arcuate flanges and the snow-stop is protected by the barrier's peripheral flange.

Referring to FIG. 8 there is shown an end elevational view of the snow guard 10, viewed up-roof along the longitudinal axis. It is seen that the angulated triangular surfaces of triangular elements 41 and 42 slope downwardly and symmetrically from either side of the longitudinal axis 51. In plan view, each triangle is an isosceles triangle having one short side, the other two being longer and of equal length. The long side coincides with the longitudinal axis 51 and the short sides 52, 53 are oppositely directed but equally inclined at an included angle $\alpha$ in the range from 45° to 60°. By "included angle" is meant the angle included by the intersection of the triangular surfaces of triangular elements 41 and 42. The short sides of the isosceles triangles intersect in the vertical plane containing the longitudinal axis so as to be free from a gap providing access to the cavity formed beneath the brace. Further, the intersection is beneath the peripheral flange 35 so as to have a meeting-plane of the laminar arcuate flanges 43 and 44 protected from falling rain.

The laminar arcuate flanges 43 and 44 are tightly fastened to the down-roof surface 32 of barrier 33, preferably by button-rivets 49. In addition to providing a meeting-plane which is protected from rain by the peripheral flange 35, laminar arcuate flanges 43 and 44 reinforce essentially all the area of the barrier 33 lying outside the pyramidal base formed by the triangular elements 41, 42 and the triangular portion of the down-roof end 22 (of the strap 20) beneath the gusset 40. The unitary structure formed by the brace 40 and snow-stop 40 is thus provided with liquid-impermeable edges and the pyramid-shaped cavity formed by the triangular elements 41, 42 and the upper surface of down-roof end 22 is thus sealed against water, greatly slowing the internal weathering of the brace and enhancing the expected useful life of the snow guard.

Figure 9:
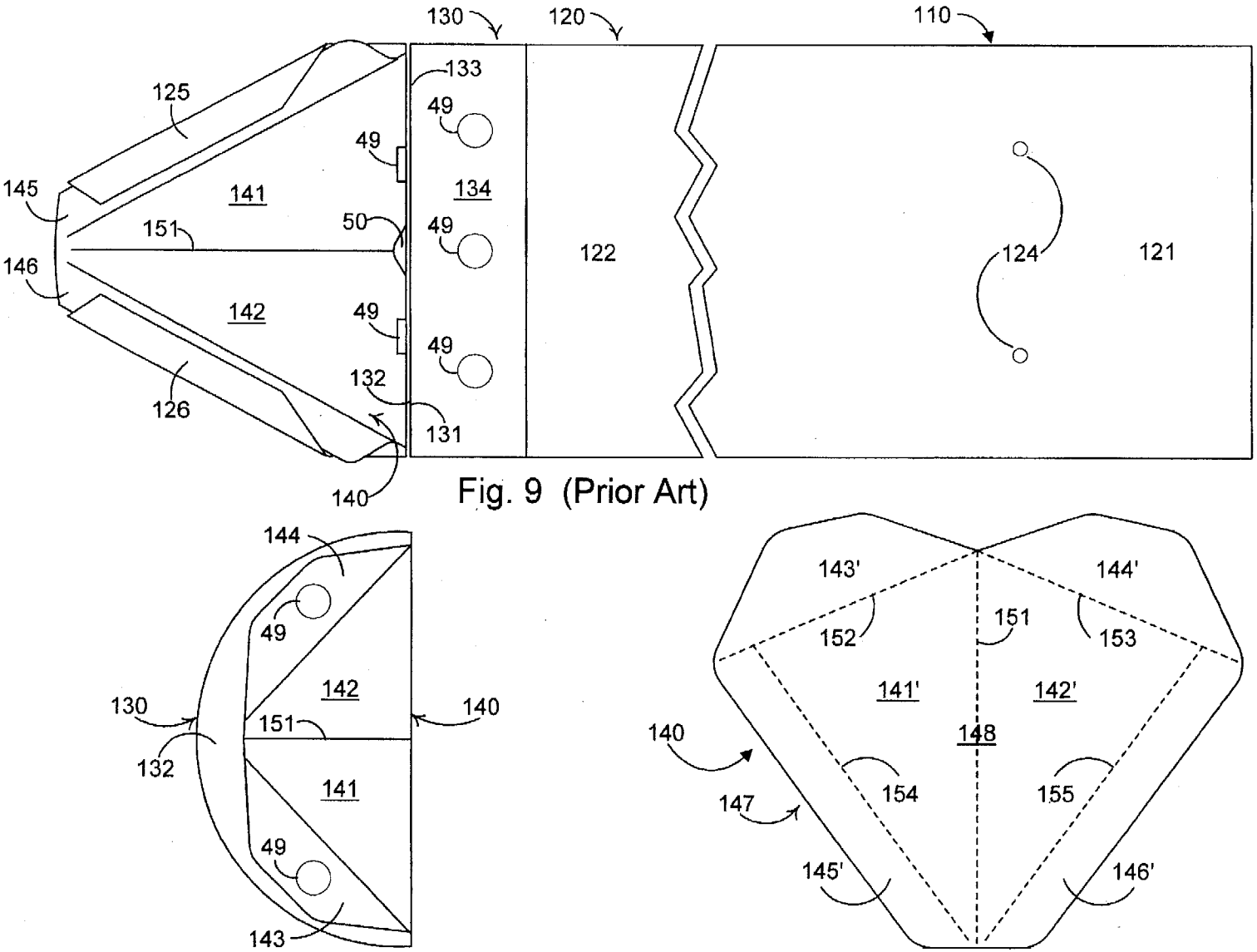
Fig. 9 (Prior Art)
FIG. 9 is a plan view of the most relevant prior art snow guard showing the gap between symmetrical trapezoidal tabs and the down-roof surface of the barrier, the gap providing a passage for entry of water under the brace because the barrier has no flange.

Referring now to FIG. 9, there is shown a plan view of an individual prior art snow-guard 110 which comprises three structural elements fixedly interconnected to produce a unitary article. The three structural elements are (a) a longitudinal laminar strap referred to generally by reference numeral 120, (b) an upstanding snow-stop 130, and (c) a unitary brace 140, having a main body portion 140' referred to in the art as a gusset. The strap 120 of a single thickness of sheet metal, has an up-roof end 121, and a down-roof end 122 which, when positioned on a shingle of a roof, lies in the longitudinal direction at a lower level than the up-roof end 121. Snow-stop 130 and brace 140 are fixedly secured to the down-roof end 122 of the strap 120 so that the snow-stop's up-roof surface 131 stops snow; the snow-stop's down-roof surface 132 is braced by the brace 140 which is downwardly inclined.

The snow-stop 130 comprises an up-standing snow-restraining barrier 133 which is integral with, and arises vertically from barrier-base 134 which is secured to the upper surface of the strap 120. Viewed down-roof along the longitudinal axis of the strap, the barrier 133 has a generally semi-circular configuration, the periphery of which is that of a portion of a planar disc. When brace 140 is secured to the down-roof surface 132 of the barrier 133 with fastening means such as button rivets 49, the trapezoidal flanges 143, 144 lie in contact with that surface except for a small central axial portion of the brace between the trapezoidal flanges which is spaced away from the down-roof surface 132 of barrier 133, forming a gap 50. This gap provides a through-passage for entry of water into the cavity beneath the brace 140. Note also that the upper edges of the flanges 143 and 144 are spaced apart from the periphery of the barrier 133. Thus both the gap and the meeting plane of the flanges 143 and 144 with the down-roof surface of the barrier are unprotected.

Referring to FIGS. 10 and 11 there is shown an end elevational view of the snow guard, and a plan view of a blank from which the brace 140 is formed, analogous to the views shown in FIGS. 8 and 4 respectively. The brace 140 is formed from a tapered laminar blank 147 shown in FIG. 11. The blank 147 is symmetrical about a longitudinal axis 151 along which opposed halves 141' and 142' of the main portion 148 are bent downwardly to form triangular elements 141 and 142, one the mirror image of the other. Dotted lines 152 and 153 indicate the lines along which opposed projecting trapezoidal tabs 143' and 144' of equal area, are bent upwardly to form upward trapezoidal flange portions 143 and 144 respectively. As before, dotted lines 154 and 155 indicate the lines along which equally angulated but opposed marginal portions 145' and 146' are bent to project laterally.

Referring to FIGS. 9, 10 and 11 it is seen that trapezoidal flanges 143 and 144 of the brace 140 are secured against the down-roof surface 132 of the barrier 133, preferably with button rivets 49. When the marginal strip portions 125, 126 are folded over marginal portions 145', 146' respectively of the down-roof end 122, liquid impermeable seals are formed which trap water entering the gap. Also as before, the angles formed by the intersection of the edges of marginal portions 145' and 146' with the longitudinal axis 151 are each in the range from 25° to 45° with respect to the longitudinal axis.

Figure 12:
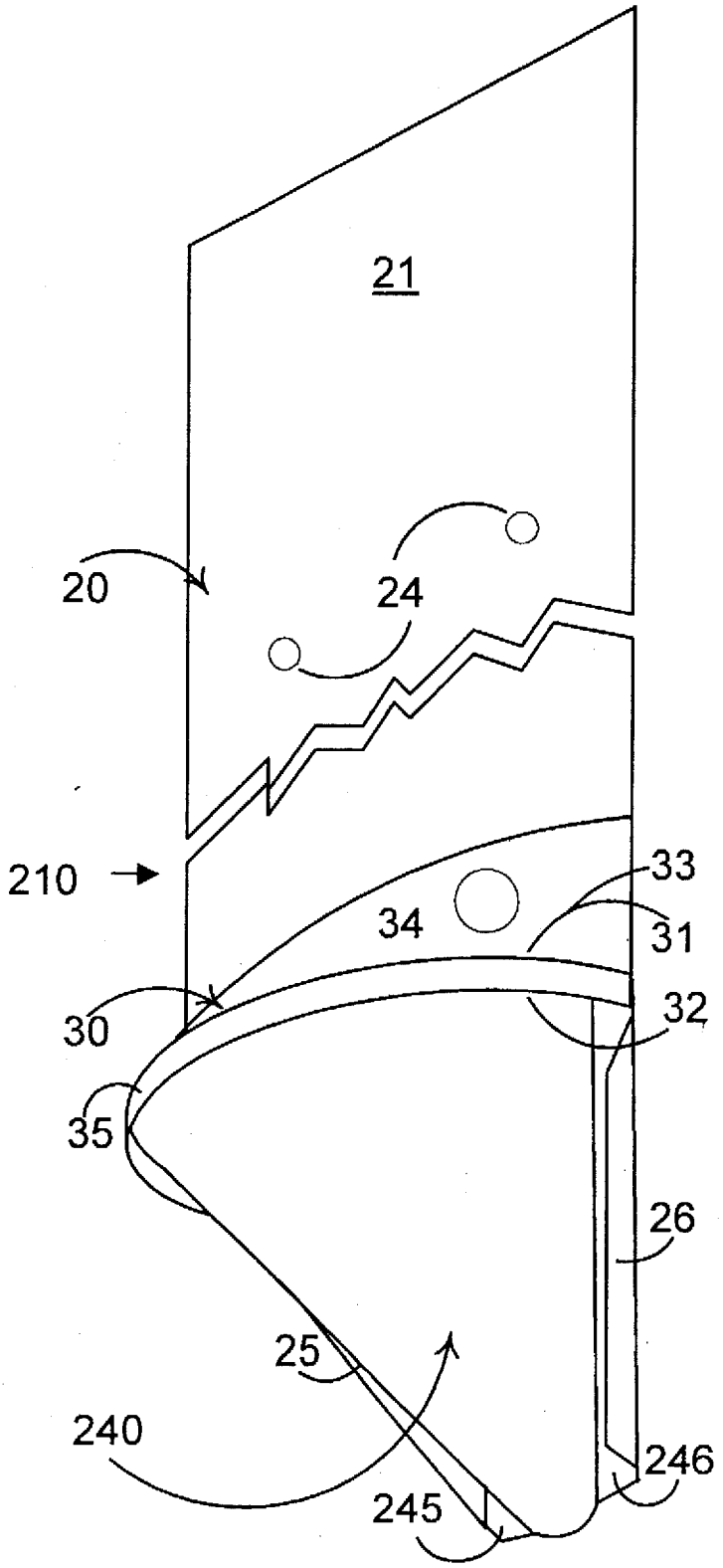
FIG. 12 is a side elevational view of the novel snow guard wherein the main body of the brace has a surface which is a portion of a cone, this surface being referred to herein as a semi-conical surface.

Referring to FIG. 12 there is schematically illustrated a snow guard 210 in which the laminar strap 20, and snow-stop 30 are substantially identical except that the brace 40 (with a gusseted main body 40' of pyramidal shape) in the snow guard 10 is substituted by a brace 240 having a gusseted main body 240' with a conical shape. The main body 240' is formed from laminar blank **47*d* illustrated in FIG. 4D. The blank is shaped so that the radius of its periphery is slightly less than the radius of the down-roof surface 32 of barrier 33, preferably in the range from 1 to 10% less so that the periphery of the conical gusset lies closely adjacent to the periphery of the barrier 33. As before, the main body 240' is provided with angulated oppositely directed laminar lateral flanges 245 and 246 which are locked under angulated side edges 25 and 26 of the down-roof portion 22 of strap 20. When so locked, the arcuate periphery of the conical gusset snugly abuts the down-roof surface 32 of the barrier 33, reinforcing the periphery of the barrier against forces exerted in the down-roof direction against the snow-stop 30. If desired, the arcuate periphery of the blank 47*d* may be provided with projecting tabs (not shown) which may be inserted through mating slots in the barrier 33, and the inserted tabs turned down against the up-roof surface of the barrier 33**.

Having thus provided a general discussion, described the overall snow guard in detail particularly in comparison with the most relevant prior art, and illustrated the invention with specific examples of the best mode of making and using the snow guard, it will be evident that the invention has provided an effective improvement of a recent solution to an age-old problem. It is therefore to be understood that no undue restrictions are to be imposed by reason of the specific embodiments illustrated and discussed, and particularly that the invention is not restricted to a slavish adherence to the details set forth herein.

I claim:

1. A snow guard comprising, a longitudinal laminar strap having an up-roof end and a down-roof end, a snow-stop fixedly secured to the upper surface of said strap, and a unitary brace fixedly secured to said snow-stop and said strap, each structural component formed from foldable sheet metal;

said strap fixedly secured at its up-roof end to a roof member, said strap having its down-roof end terminating in a generally triangular shape having angulated edges symmetrically oppositely disposed about said strap's longitudinal axis;

said snow-stop comprising (i) a generally planar upstanding barrier having an arcuate profile, an up-roof surface and a down-roof surface, said barrier having a peripheral flange means projecting orthogonally from the periphery of said barrier for a distance sufficient to protect said down-roof surface against impingement by rain; and (ii) a barrier-base in overlying contact with said down-roof end's upper surface and fixedly secured thereto, said barrier-base projecting laterally up-roof, at a right angle with said barrier; and, said unitary brace comprising a downwardly tapered main body comprising a gusset having a chosen outer surface area and lateral flanges, each lateral flange projecting from a side of said gusset, angularly relative to said longitudinal axis, in opposed directions, said lateral flanges lying in contact with said strap and tightly secured by said angulated edges which are folded over said lateral flanges, said main body having a large opening defined by a cross-section m a vertical plane of abutment where the up-roof portion of said gusset abuts said barrier as it rests on said laminar strap, said large opening having an arcuate periphery which so closely conforms to said barrier's down-roof surface as to leave no gap between said arcuate periphery and said barrier's down-roof surface;

whereby said barrier's periphery is reinforced by said peripheral flange means, enhancing rigidity and strength of said brace and snow-stop, and, entry of melting snow and falling rain in the meeting plane between said barrier's down-roof surface is prevented.

2. The snow guard of claim 1 wherein said gusset comprises a pyramidal shape having from 2 to 8 triangular elements, each having at least one side in common with a contiguous triangular element, and said large opening's arcuate periphery is serrated.

3. The snow guard of claim 1 wherein said gusset comprises a conical shape, and said large opening's arcuate periphery is an arc having a radius chosen to conform closely to that of the arcuate peripheral profile of said barrier.

4. The snow guard of claim 1 wherein said peripheral flange means on said barrier is beveled downwards to tightly confine the periphery of said up-roof end of said gusset.

5. The snow guard of claim 2 wherein each said triangular element includes a vertical, laminar, arcuate flange portion disposed in contact with said barrier's down-roof surface, each said arcuate flange portion having an arcuate periphery extending along an arc circumscribed around all arcuate flange portions, said arc having a radius matching that of said periphery of said peripheral flange means.

6. The snow guard of claim 5 wherein at least one of said vertical laminar arcuate flange portions is securely fastened to said barrier.

7. The snow guard of claim 5 wherein said arcuate profile is generally semi-circular and said arc has a radius ±20% of the radius of said arcuate profile.

8. The snow guard of claim 1 wherein said peripheral flange means is circumferentially substantially continuous.

9. The snow guard of claim 1 wherein said foldable sheet metal has a thickness in the range from about 0.5 mm to about 1 mm.

10. The snow guard of claim 1 wherein said up-roof end of said longitudinal strap extends beyond a shingle of slate or tile and said up-roof end is fastened directly to said roof deck.

11. The snow guard of claim 1 wherein said up-roof end of said longitudinal strap fails to extend beyond a shingle of asphaltic material and said up-roof end is fastened through said shingle of asphaltic material to said roof deck.

12. In a snow guard comprising structural components formed of a foldable sheet metal, a longitudinal laminar strap having an up-roof end and a down-roof end, adapted to be fixedly secured by its up-roof end to a roof member, and having said strap's down-roof end terminating in a generally triangular shape having angulated edges symmetrically disposed about said strap's longitudinal axis;

an upstanding snow-stop fixedly secured upon said down-roof end and projecting upward therefrom, said snow-stop comprising (i) a generally planar semi-circular upstanding barrier of chosen radius having an up-roof surface and a down-roof surface, and (ii) a barrier-base in overlying contact with said strap's upper surface, and projecting up-roof at a right angle with said semi-circular barrier; and, a unitary brace comprising a downwardly tapered main body comprising a gusset having vertically projecting flange portions symmetrically disposed about a vertical plane containing the longitudinal axis, and laterally projecting flanges projecting angularly in opposed directions symmetrically about said vertical plane each said vertically projecting flange portion fastened to said barrier, the improvement comprising, said barrier having a peripheral flange means proJecting orthogonally from the periphery of said barrier for a distance sufficient to protect said down-roof surface against impingement by rain;

each said vertically projecting flange portion having an arcuate periphery extending along an arc circumscribed around all arcuate flange portions, said arc having a radius matching that of said periphery of said barrier, said arcuate flange portions being secured in contact with said barrier's down-roof surface along substantially said barrier's entire periphery, without leaving a space therebetween;

said barrier having a peripheral flange means along a major portion of said barrier's periphery, said flange means extending orthogonally over said barrier's down-roof surface and over said arcuate flange portions;

whereby said barrier's periphery is reinforced by said peripheral flange means and said arcuate flanges fastened to said barrier's down-roof surface and entry of melting snow and falling rain in the meeting plane between said barrier's down-roof surface is prevented.

13. The snow guard of claim 12 wherein said peripheral flange means is a circumferentially substantially continuous peripheral flange.

14. The snow guard of claim 13 wherein said snow-stop is formed from a cast metal.

15. The snow guard of claim 13 wherein said peripheral flange means is beveled downward to form a lip and each said arcuate flange portion is confined within said lip.

16. The snow guard of claim 13 wherein said foldable sheet metal is selected from the group consisting of copper and galvanized steel, copper sheet stock being in the range from 16 oz/ft$^2$ (ounces/square foot) to 40 oz/ft$^2$, and galvanized steel sheet stock being in the range from 26 gauge to 18 gauge.

17. The snow guard of claim 13 wherein said up-roof end of said longitudinal strap extends beyond a shingle of slate or tile and said up-roof end is fastened directly to said roof deck.

* * * * *